US012127692B2

(12) United States Patent
Brown

(10) Patent No.: US 12,127,692 B2
(45) Date of Patent: Oct. 29, 2024

(54) INFANT SUPPORT PILLOW

(71) Applicant: Rodney A Brown, Winter Springs, FL (US)

(72) Inventor: Rodney A Brown, Winter Springs, FL (US)

( * ) Notice: Subject to any disclaimer, the term of this patent is extended or adjusted under 35 U.S.C. 154(b) by 0 days.

(21) Appl. No.: 18/401,903

(22) Filed: Jan. 2, 2024

(65) Prior Publication Data

US 2024/0225304 A1 Jul. 11, 2024

Related U.S. Application Data

(60) Provisional application No. 63/437,722, filed on Jan. 8, 2023.

(51) Int. Cl.
*A47D 15/00* (2006.01)
*A47G 9/10* (2006.01)

(52) U.S. Cl.
CPC ..... *A47D 15/008* (2013.01); *A47G 9/1081* (2013.01); *A47G 2009/1018* (2013.01)

(58) Field of Classification Search
CPC ..... A47D 15/008; A47G 9/10; A47G 9/1081; A47G 2009/1018; A61F 5/05891; A61F 5/3707
See application file for complete search history.

(56) References Cited

U.S. PATENT DOCUMENTS 2,876,459 A * 3/1959 Ackerson ..... A47K 3/127 4/659
5,018,231 A * 5/1991 Wang ..... A47G 9/10 5/636
5,813,065 A * 9/1998 Tinhorn ..... A47G 9/10 5/639
5,848,448 A * 12/1998 Boyd ..... A47G 9/10 5/636
6,052,849 A * 4/2000 Dixon ..... A47D 15/008 5/643
7,418,752 B2 * 9/2008 Kemm ..... A47D 13/08 5/655
8,758,283 B2 * 6/2014 Rogers ..... A61F 5/05891 602/17
D817,032 S * 5/2018 Yang ..... D6/601
11,259,657 B1 * 3/2022 Molina ..... A47G 9/0253
(Continued)

FOREIGN PATENT DOCUMENTS

CN 107536360 A * 1/2018 ..... A47G 9/1054
CN 109965626 A * 7/2019
KR 200476264 Y1 * 2/2015

*Primary Examiner* — Eric J Kurilla

(74) *Attorney, Agent, or Firm* — Bullock Law; Stephen Bullock

(57) ABSTRACT

An infant support pillow including a pillow base with a first rounded depression, a second rounded depression and a ridge separating the first rounded depression and second rounded depression. The first rounded depression has a top to bottom depth greater than the second rounded depression. The first rounded depression and second rounded depression form a first depression crater and a second depression crater in the pillow base and the first depression crater is sized to match the average dimensions of the back of an infant's head. Similarly, the second depression crater is sized to match the average dimensions of the back of an infant's neck.

19 Claims, 8 Drawing Sheets

(56) References Cited

U.S. PATENT DOCUMENTS

| | | | | |
|---|---|---|---|---|
| 2002/0174488 | A1* | 11/2002 | Appleton | A47D 15/008 5/731 |
| 2005/0164582 | A1* | 7/2005 | McGuire | D04H 1/5414 442/361 |
| 2008/0149113 | A1* | 6/2008 | Kendrick | A61F 5/30 128/857 |
| 2011/0108040 | A1* | 5/2011 | Tullous | A61F 5/01 128/845 |
| 2013/0138026 | A1* | 5/2013 | Tullous | A61F 5/05891 602/17 |
| 2014/0317852 | A1* | 10/2014 | Chen | A47G 9/109 5/644 |
| 2016/0143463 | A1* | 5/2016 | Verde Sanchez | A47G 9/10 5/655 |
| 2017/0095096 | A1* | 4/2017 | Mandell | A47C 15/00 |
| 2017/0265647 | A1* | 9/2017 | Galloway | A47G 9/0246 |
| 2018/0274143 | A1* | 9/2018 | Wahlquist | D04H 1/49 |
| 2020/0093297 | A1* | 3/2020 | Dennewald | A47G 9/1081 |
| 2020/0138203 | A1* | 5/2020 | Breen | A47D 15/008 |
| 2022/0175150 | A1* | 6/2022 | Ortega | A47G 9/0246 |
| 2023/0380611 | A1* | 11/2023 | Josette | A47G 9/1081 |

* cited by examiner

INFANT SUPPORT PILLOW

FIELD OF THE INVENTION

The present invention relates to specially designed pillows. In particular, the present invention relates to an infant head support pillow and associated methods.

BACKGROUND

In 1992 the AAP Task Force on infant positioning and SIDS recommended that healthy infants be positioned on their backs when put down for sleep. This initiated the "back to sleep" campaign. However, along with the initiative has been a dramatic increase in the prevalence of positional plagiocephaly, which currently affects as many as 46.6% of infants at three months of age. Positional plagiocephaly is the flattening of an infant's head. There can be associated misalignment of the ears and forehead as well as torticollis or wry neck. Unfortunately, even with current repositioning techniques the majority of these infants must wear a helmet to correct the plagiocephaly. Not only is the helmet a significant cost, but it may cause tightening of the neck muscles, which may limit eye movement.

There exists a need in the art for a pillow that provides a shaped surface to prevent infant positional plagiocephaly and that is capable of correcting the condition in infants once it has occurred. Therefore, there exists a need in the art for an infant support pillow as claimed and described herein.

SUMMARY OF THE INVENTION

Embodiments of the present invention are related to a molded pillow with a pillow base including a first rounded depression, a second rounded depression and a ridge separating the first rounded depression and second rounded depression. The first rounded depression may have a top to bottom depth greater than the second rounded depression. The first rounded depression and second rounded depression may form a first depression crater and a second depression crater in the pillow base. Furthermore, the first depression crater may be sized to match the average dimensions of the back of an infant's head and the second depression crater may be sized to match the average dimensions of the back of an infant's neck The pillow base may be a half sphere with a flat bottom and a rounded top. The rounded top may house the first depression and the second depression. The pillow base may be made from a rigid polyester bi-component low melt fiber material. The first rounded depression may be centrally located within the pillow base and the second rounded depression may be located proximate a pillow base front. In some embodiments, the second rounded depression may have a smaller diameter than the first rounded depression.

Another embodiment of the invention may include a molded pillow with a pillow base including a first rounded depression, a second rounded depression, a ridge separating the first rounded depression and second rounded depression, and a flexible covering enveloping the pillow base. The first rounded depression may have a top to bottom depth greater than the second rounded depression and the flexible covering may be structured to resistively sink into the first rounded depression and the second rounded depression when external force is applied. In this embodiment, the flexible covering may be structured to suspend the back of an infant's head within the first rounded depression. Likewise, the flexible covering may include a tension overtop the first rounded depression and second rounded depression structured to conform the fabric geometrically to a majority of the first rounded depression and second rounded depression when external force is applied.

The first rounded depression and the second rounded depression may be concave indentions in the pillow base and the flexible covering may be made of at least one of spandex, polyester, and cotton. The pillow base may include a first exterior depth measured from a back edge of the first rounded depression that is greater than a second exterior depth measured from a front edge of the second rounded depression. The first rounded depression may be molded to match the average dimensions of the back of an infant's head and the second rounded depression may be molded to match the average dimensions of the back of an infant's neck.

Another embodiment of the invention may be a molded pillow with a pillow base including a first rounded depression, a second rounded depression, a ridge separating the first rounded depression and second rounded depression, a flexible covering enveloping the pillow base, and a fitted sheet fixedly attached to at least one of the flexible covering and the pillow base. The first rounded depression may be molded to match the average dimensions of the back of an infant's head and the second rounded depression may be molded to match the average dimensions of the back of an infant's neck. The first rounded depression may have a top to bottom depth greater than the second rounded depression and the flexible covering may be structured to resistively sink into the first rounded depression and the second rounded depression when external force is applied.

In this embodiment, the pillow base may be a half sphere with a flat bottom and a rounded top. Furthermore, the rounded top may house the first depression and the second depression.

DETAILED DESCRIPTION OF THE INVENTION

The present invention will now be described in detail with reference to the accompanying drawings. The embodiment descriptions are illustrative and not intended to be limiting in any way. Other embodiments of the invention will readily suggest themselves to persons with ordinary skill in the art after having the benefit of this disclosure. Accordingly, the following embodiments are set forth without any loss of generality and without imposing limitation upon the claimed invention.

Directional terms such as "above" "below" "upper" "lower" and other like terms are used for the convenience of the reader in reference to the drawings. Additionally, the description may contain terminology to convey position, orientation, and direction without departing from the principles of the present invention. Such positional language should be taken in context of the represented drawings.

Quantitative terms such as "generally" "substantially" "mostly" and other like terms are used to mean that the referred object, characteristic, or quality constitutes a majority of the referenced subject. Likewise, use of the terms such as first and second do not necessarily designate a limitation of quantity. Such terms may be used as a method of describing the presence of at least one of the referenced elements or may provide a means of differentiating orientation. The meaning of any term within this description is dependent upon the context within which it is used, and the meaning may be expressly modified.

Figure 1:
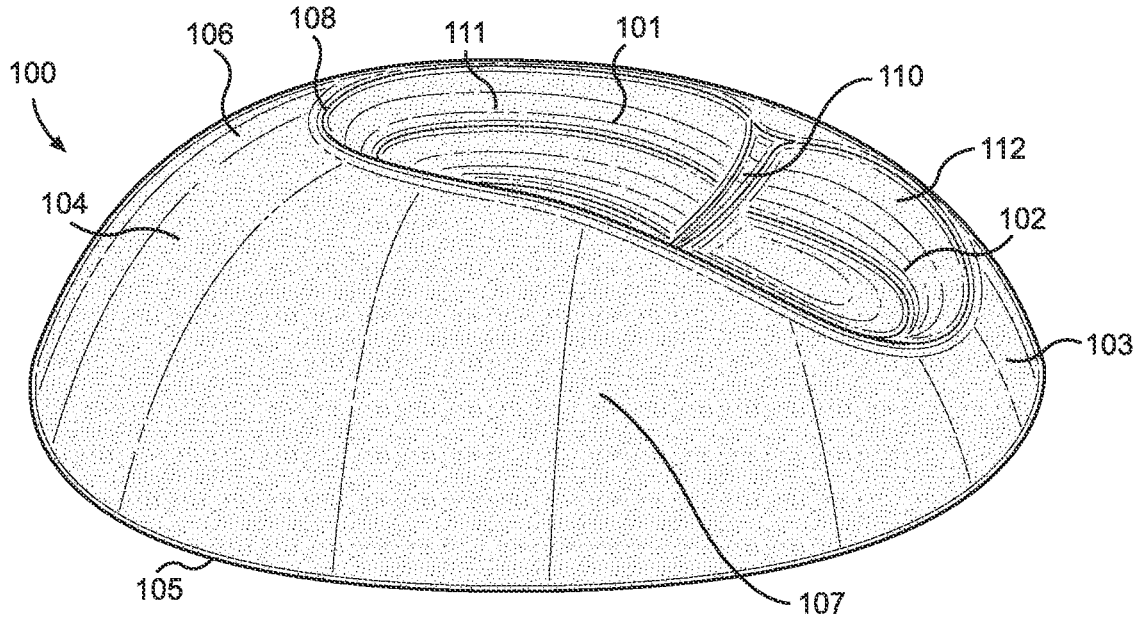
FIG. 1 is a front perspective view of the infant support pillow according to an embodiment of the invention.
Figure 2:
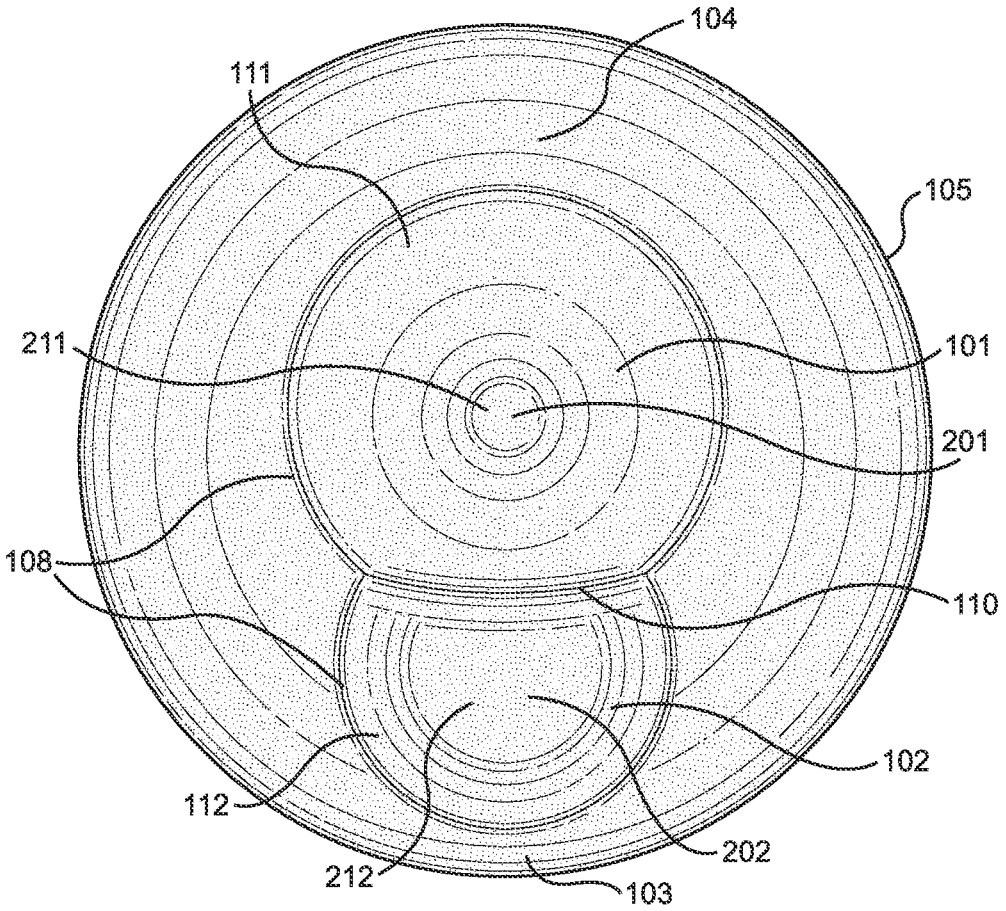
FIG. 2 is a top view of the infant support pillow illustrated in FIG. 1.

Referring now to FIGS. 1 and 2, a molded infant support pillow and more specifically the molded pillow base 100, hereinafter base 100, will be described more fully. The base 100 may be a bisected sphere made of rigid foam like material. In some embodiments, the base 100 may be made from densified polyester fibers such as polyester bi-component low melt fiber. This carded and stacked fiber may be molded at specified temperatures to achieve the desired shape. When cooled, the cushioned base 100 may be sturdy and provide a secure supportive rebounding effect when pressure is applied.

As shown, the base 100 may include a front 103, a back 104, a bottom 105 a top 106, and sides 107. It may generally be a half sphere with a flat bottom 105 and a rounded top 106. The bottom 105 may include a circular border, but may be a flat plane to provide a stable foundation. The top 106 may itself be rounded and may include a first rounded depression 101 and a second rounded depression 102 each forming a respective crater, or concave indention therein. Hence, the first rounded depression 101 may include curved first depression inner walls 111 and the second rounded depression 102 may include curved second depression inner walls 112. Each rounded depression 101, 102 may be bordered by a depression edge 108 at the top 106. Furthermore, there may be a ridge 110 between the first rounded depression 101 and second rounded depression 102 separating the two. The first rounded depression 101 may have a top to bottom depth greater than the second rounded depression 102.

Figure 3:
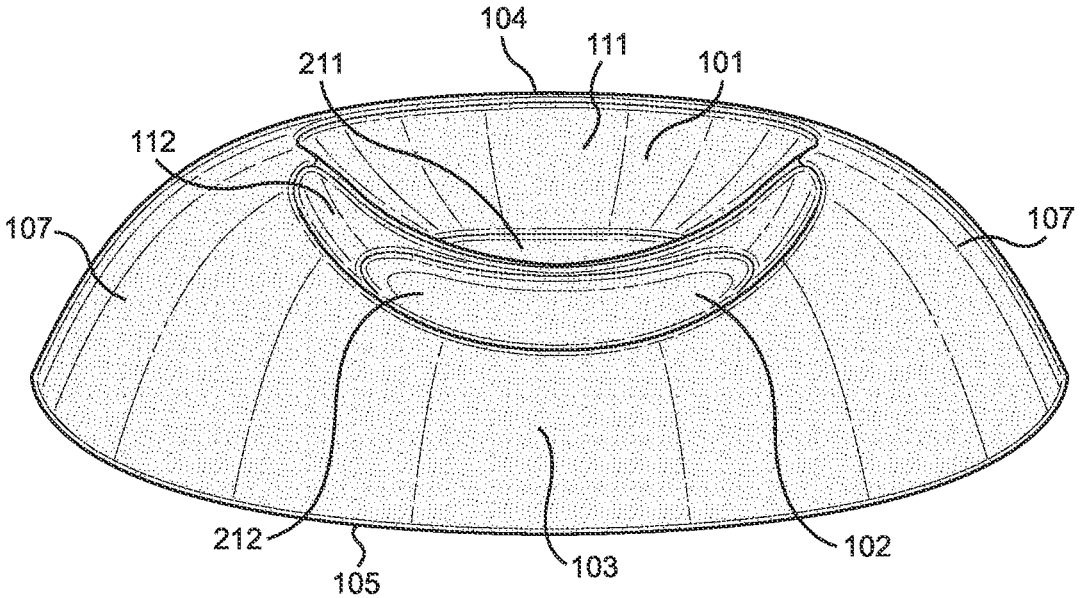
FIG. 3 is a front view of the infant support pillow illustrated in FIG. 1.

FIGS. 2 and 3 emphasize the depth disparity of the depressions 101, 102 within the base 100 and show the first depression inner walls 111 and second depression inner walls 112 culminating into a first depression center 201 and a second depression center 202. As shown, there may be a disparate first depression depth 211 and second depression depth 212 from the depression edge 108 to respective depression centers 201, 202. In other words, the first rounded depression 101 may be a deeper crater within the top 106 than the second rounded depression 102. In some embodiments, the second rounded depression 102 may have a smaller diameter than the first rounded depression 101. Furthermore, in some embodiments, the first rounded depression 101 may be divided into a major segment with the ridge 110 acting as a dividing chord flattening out its front portion. Likewise, the second rounded depression 102 may be divided into a major segment with the ridge 110 acting as a dividing chord flattening out its back portion.

Figure 4:
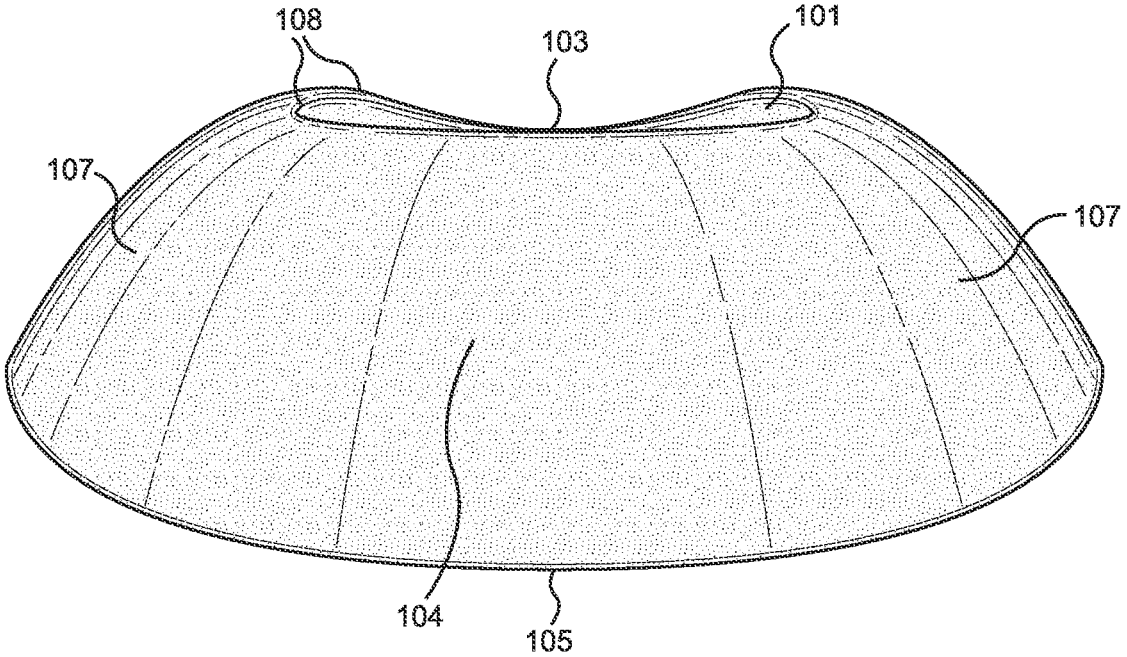
FIG. 4 is a back view of the infant support pillow illustrated in FIG. 1.

FIG. 4 illustrates the base 100 from the back 104 and features the rounded top 106 with a thicker back 104. Each side 107 is shown extending from the bottom 105 to the depression edge 108 of the first depression 101. Therefore, by comparison the back 104 may be larger from bottom 105 to depression edge 108 than the front 103.

Figure 5:
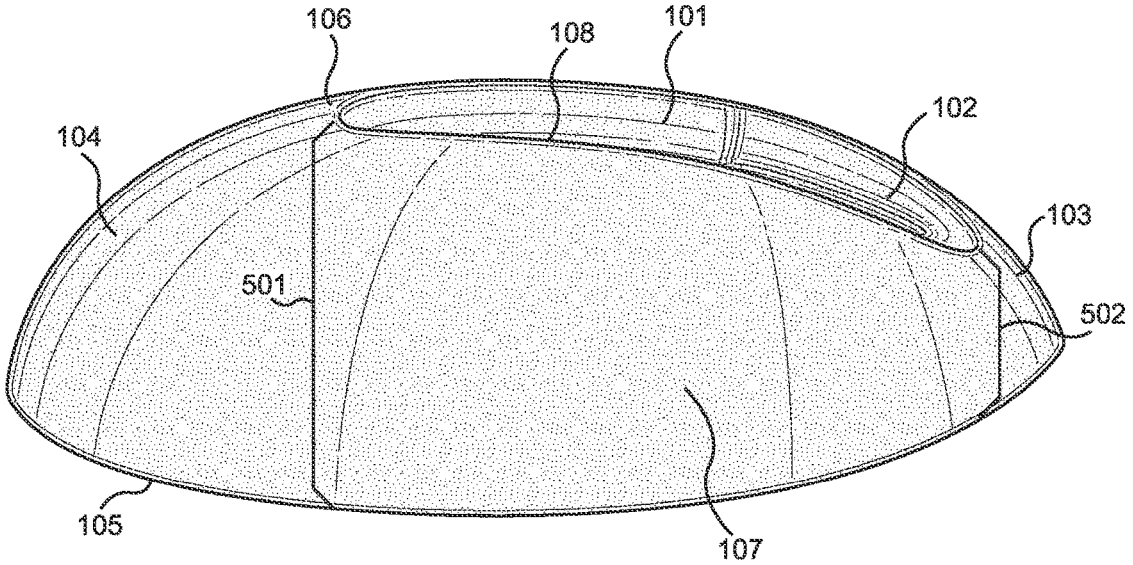
FIG. 5 is a side view of the infant support pillow illustrated in FIG. 1.

FIG. 5 emphasizes the depth disparity between the front 103 and the back 104 with respect to the depression edge 108. As shown, the base 100 may have a first exterior depth 501 and a second exterior depth 502. The first exterior depth 501 may extend from the bottom 105 to a back portion of the depression edge 108. The second exterior depth 502 may extend from the bottom 105 to a front portion of the depression edge 108. As illustrated, the first exterior depth 501 may be larger than the second exterior depth 502. In some embodiments, this may be by a ratio of 2 to 1. However, one skilled in the art will appreciate that the ratio may be more or less depending on need, preference, and circumstance.

Further shown is that in some embodiments the first rounded depression 101 may be centrally located within the base 100 and the second rounded depression 102 may be located proximate the front 103. This offset may create the difference in the first exterior depth 501 and second exterior depth 502.

Figure 6:
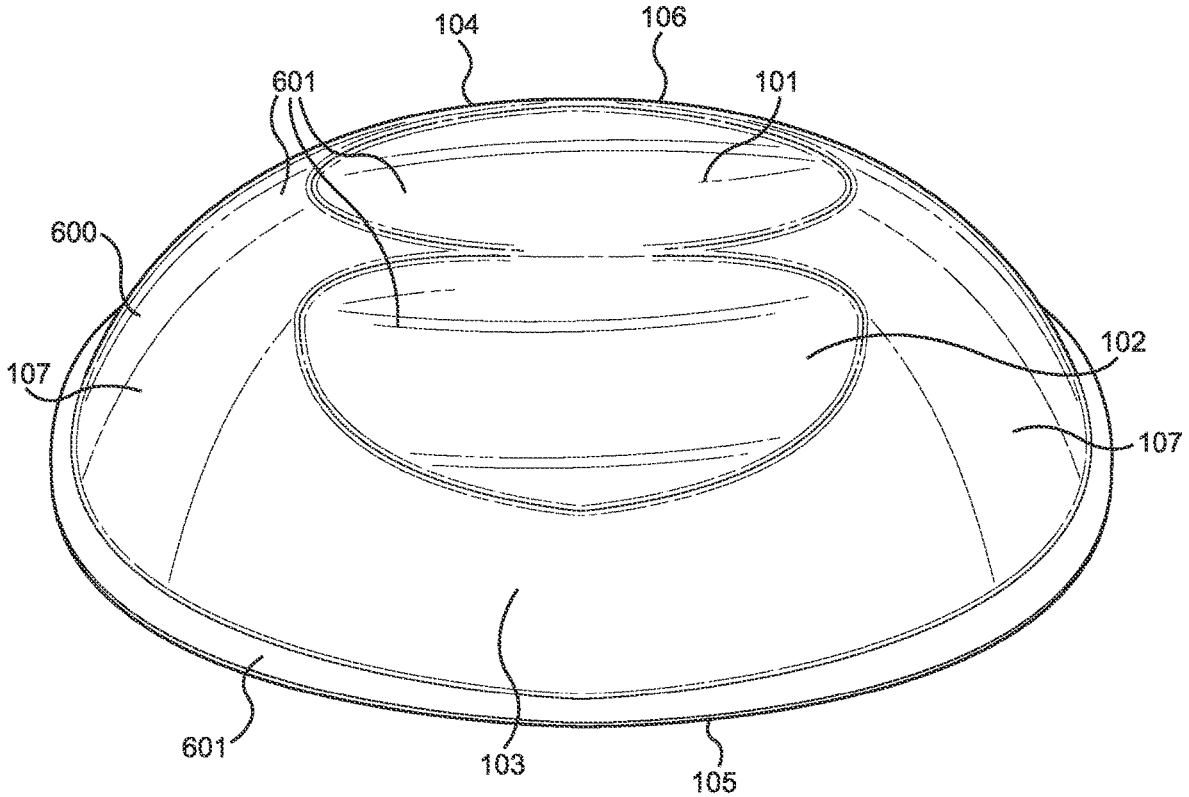
FIG. 6 is a front view of the infant support pillow according to an embodiment of the invention.

FIG. 6 illustrates the infant support pillow 600 with a flexible covering 601 enveloping the exterior of the base 100. The flexible covering 601 may be made of any one or a combination of spandex, polyester, cotton, and the like. It may extend around the back 104, sides 107 and top 106 and may extend over the first depression 101 and second depression 102. In some embodiments, the flexible covering 601 may envelop the bottom 105 as well.

Figure 7:
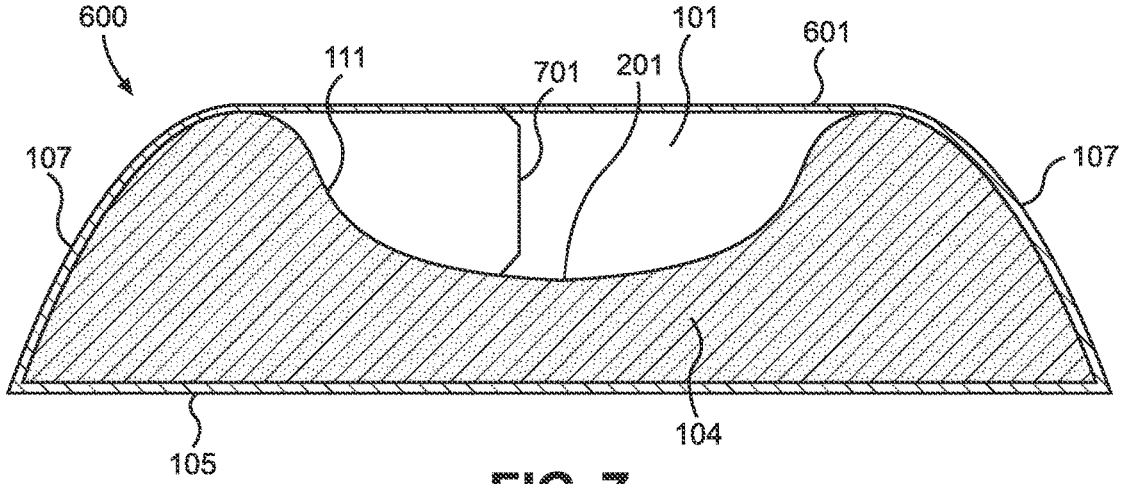
FIG. 7 is a back cross-sectional view of the infant support pillow illustrated in FIG. 6.

FIG. 7 is a back cross-sectional view of the covered infant support pillow 600 and shows how the flexible covering 601 may create a supported void 701. In this view, the first depression 101 is shown covered by the flexible covering 601 with the concave nature of the depression and curved first depression inner walls 111 creating the supported void 701 with a peak depth at the first depression center 201.

Figure 8A:
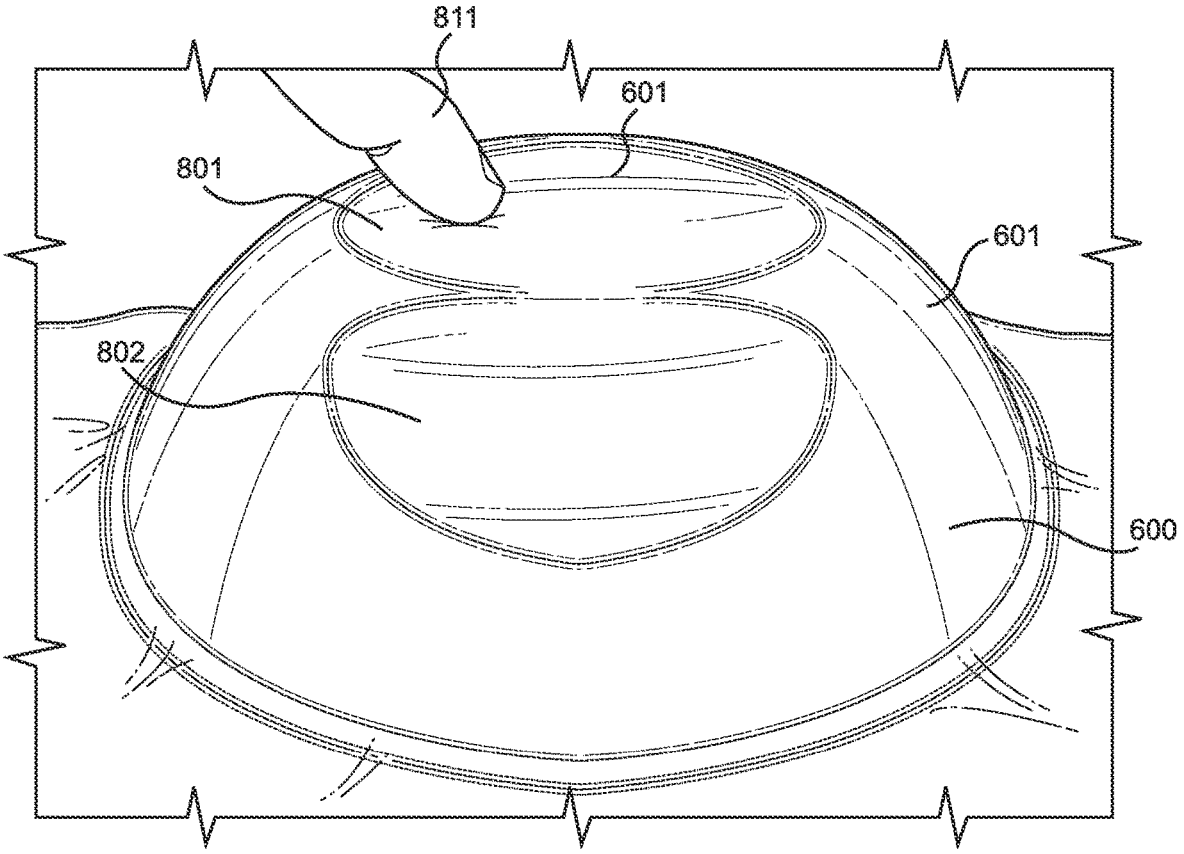
FIG. 8A is a demonstrative front perspective view of the infant support pillow illustrated in FIG. 6.
Figure 8B:
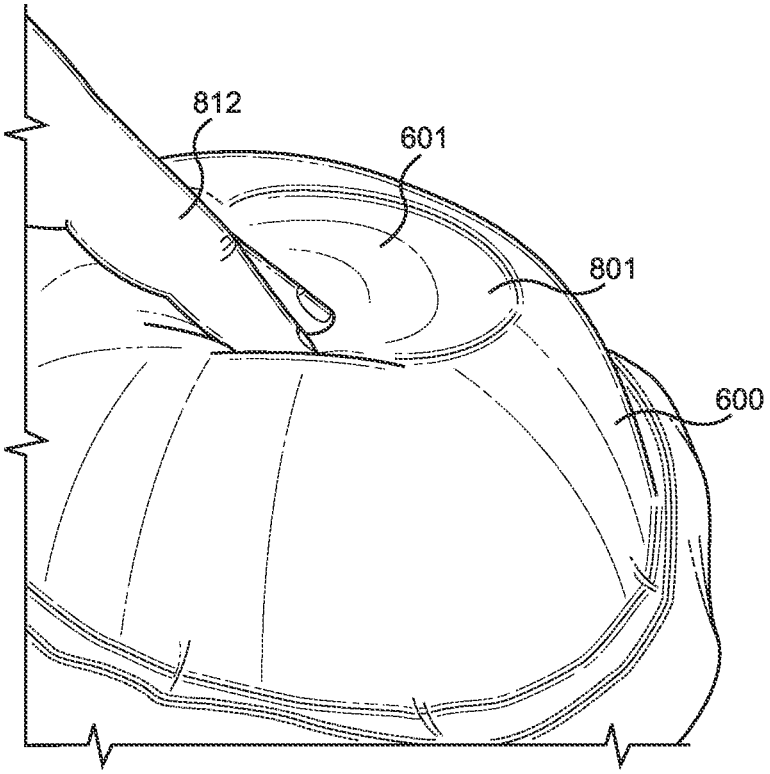
FIG. 8B is a demonstrative side perspective view of the infant support pillow illustrated in FIG. 6.

FIGS. 8A and 8B illustrate how the flexible covering 601 may interact with the covered first depression 801 and covered second depression 802. In these views, a first environmental demonstration 811 shows a finger engaging the supported void 701 of the covered first depression 801. A second environmental demonstration 812 shows two fingers applying external force and sinking deeper into the supported void 701 of the first covered depression 801. This illustrates that the flexible covering 601 may resistively sink into the covered depressions 801, 802 when external force is applied.

Figure 9:
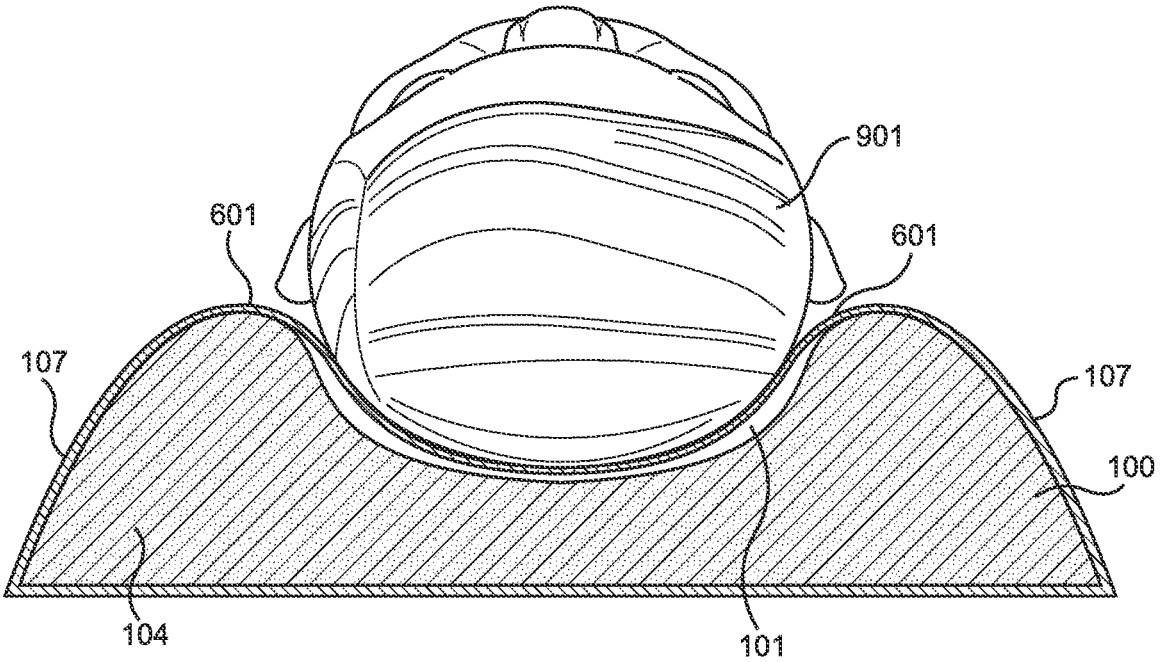
FIG. 9 is a back cross-sectional environmental view of the infant support pillow illustrated in FIG. 6.

FIG. 9 further demonstrates how the covered infant support pillow 600 and more specifically the supported void 701 may be used. An infant's head 901 may lay on top of the covered infant support pillow 600 whereby the back of their head 901 may engage the covered first depression 801. The flexible covering 601 thereby resistively sinks into the first rounded depression 101. The flexible covering 601 may include a tension overtop the first rounded depression 101 and second rounded depression 102. The flexible covering 601 may be structured to suspend the back of the infant's head 901 within the first rounded depression 101, but may also be structured to conform the flexible fabric 601 geometrically to a majority of the first rounded depression 101 and second rounded depression 102 when that external force is applied.

Figure 10A:
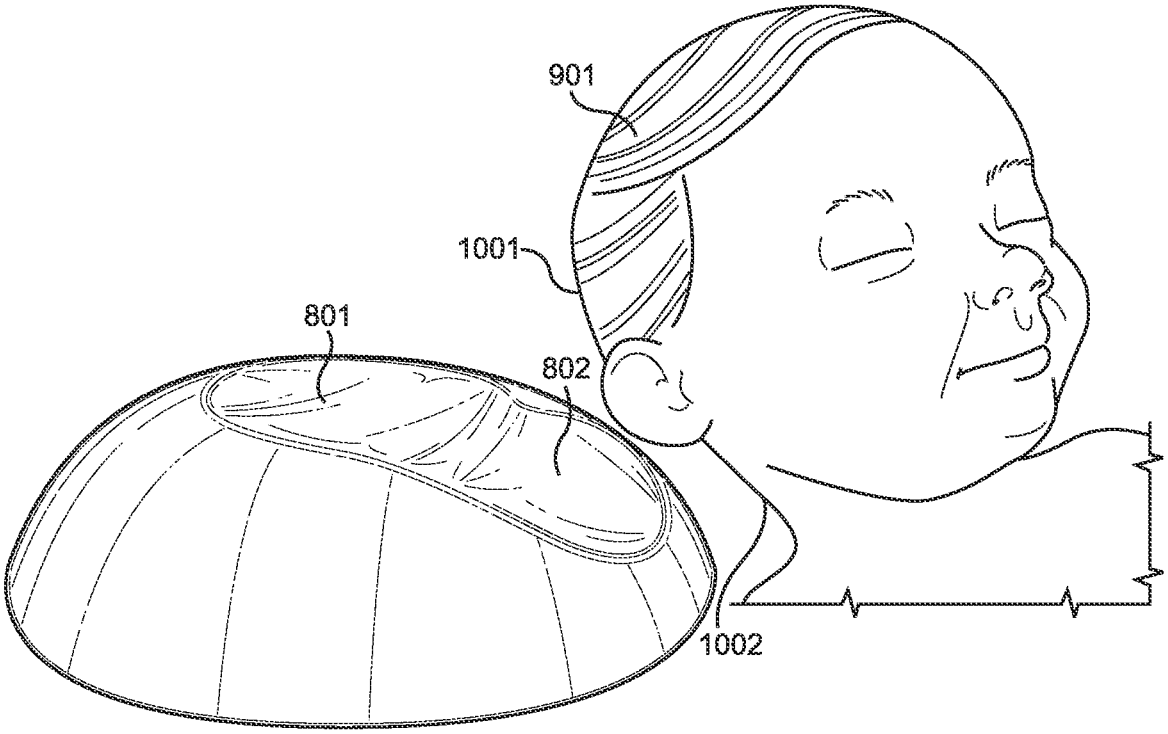
FIG. 10A is an environmental perspective view of the infant support pillow illustrated in FIG. 6.
Figure 10B:
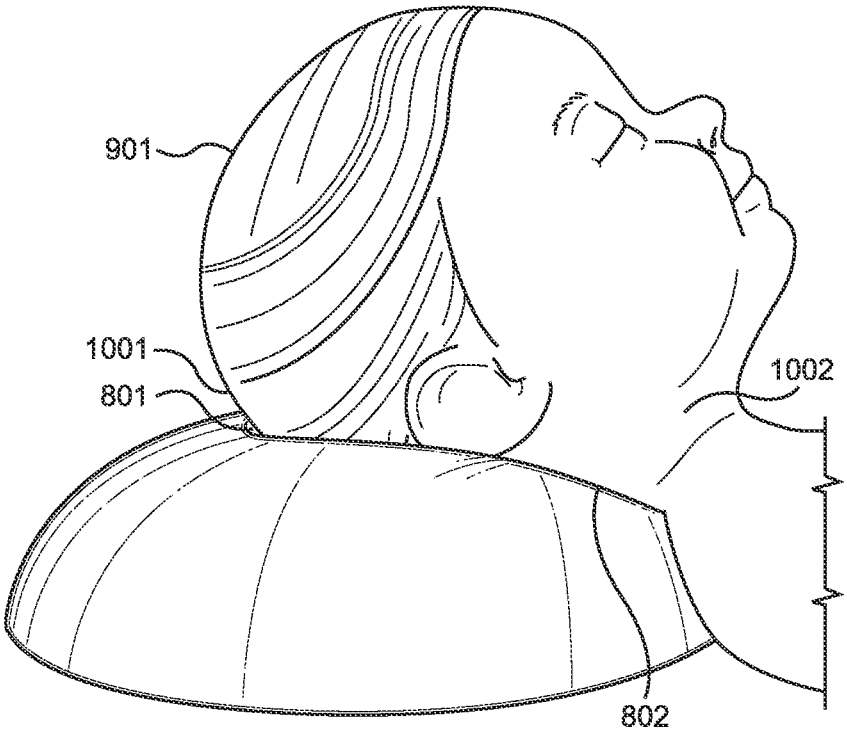
FIG. 10B is an environmental side view of the infant support pillow illustrated in FIG. 6.
Figure 11:
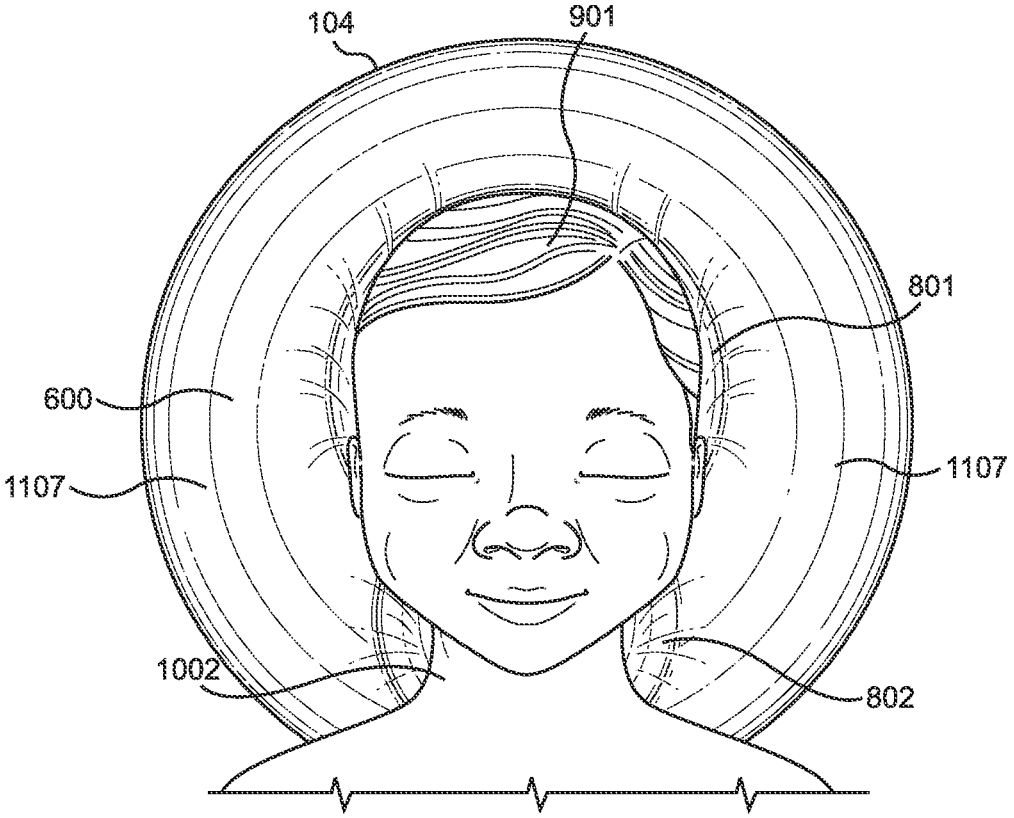
FIG. 11 is an environmental top view of the infant support pillow illustrated in FIG. 6.

FIGS. 10A, 10B and 11 show a perspective, side and overhead view of an infant using the covered infant support pillow 600. These views illustrate how the back of the infant's head 1001 and neck 1002 align with the first covered depression 801 and second covered depression 802 respectively. Therefore, the back of the infant's head 1001 may fit within the first covered depression 801 and sink therein when being used. Likewise, the back of the infant's neck may fit within the second covered depression 802 when being used. The covered sides 1107 may assist with providing tension overtop the first rounded depression 101 and second rounded depression 102 to conform the fabric geometrically to a majority of the first rounded depression 101 and second rounded depression 102 when the infant's head 901 is on top thereof.

Of particular importance is that the craters formed by the first rounded depression 101 and second rounded depression 102 may be sized to match the average dimensions of the back of an infant's head 1001 and neck 1002 respectively. In some embodiments, these sizes may be structured in accordance with measurements found in government and pediatric growth databases such as the American Academy of Pediatrics (AAP) and the Center for Disease Control (CDC). Therefore, the covered depressions 801, 802 may assist with correcting an infant's flattened head as well as maintaining an already rounded head shape.

Figure 12:
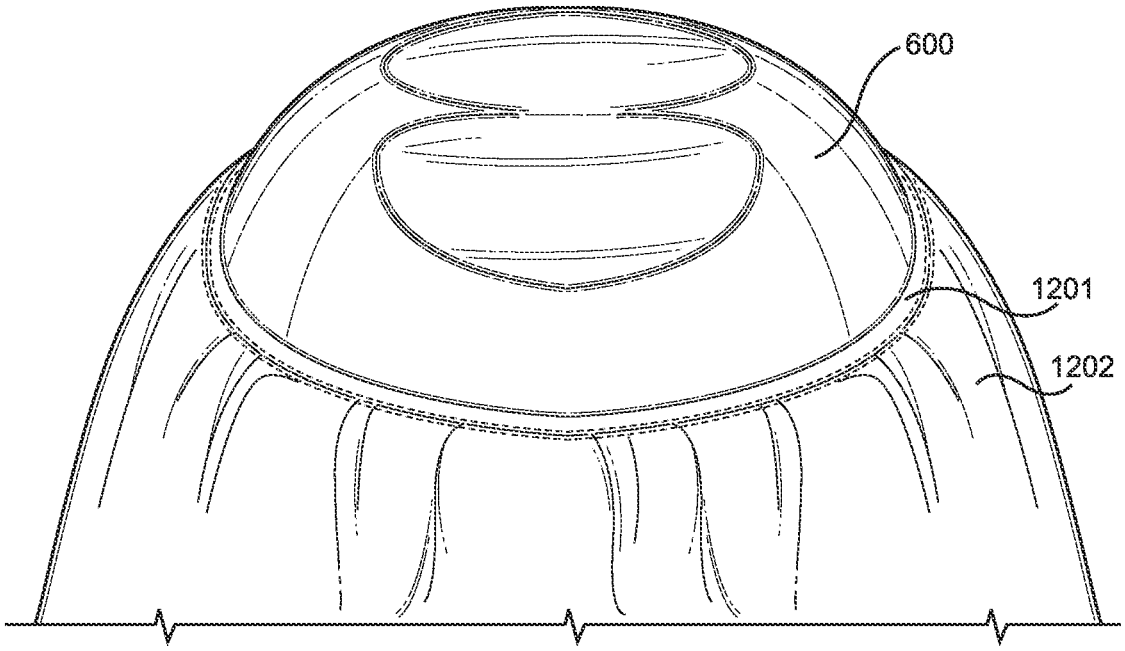
FIG. 12 is a front view of the infant support pillow according to an embodiment of the invention.
Figure 13:
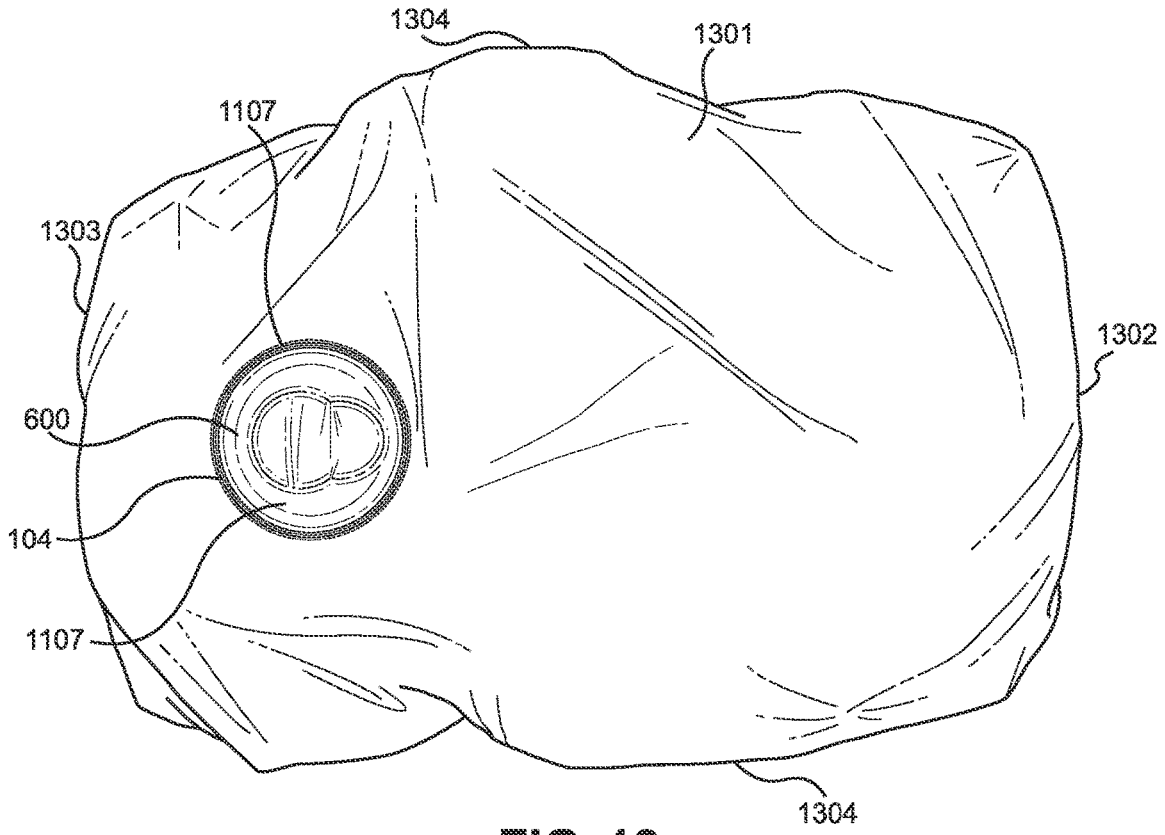
FIG. 13 is a top view of the infant support pillow illustrated in FIG. 12.

FIGS. 12 and 13 illustrates the covered pillow 600 incorporated into a fitted sheet 1202. As shown, there may be a fixed attachment section 1201 whereby the covered pillow 600 is fixedly attached to the fitted sheet 1202. The attachment may be to the flexible covering 601 or in some embodiments directly to the base 100. In some embodiments the fitted sheet may be sewn onto the base 100. However, one skilled in the art will appreciate that the attachment may be any one of a hook and loop fastener, zipper, snap fit, and the like. This fixed attachment may prevent the covered pillow 600 from prolapsing within a newborn's crib thereby alleviating potential dangers associated therewith.

The fitted sheet 1301 may include a bottom 1302, a top 1303, and sides 1304. The back 104 of the covered pillow 600 may be oriented so that it faces the fitted sheet top 1303. Likewise, the front 103 of the covered pillow 600 may be oriented so that it faces the fitted sheet bottom 1302. Each respective covered side 1107 of the covered pillow 600 may align with the fitted sheet sides 1304.

Figure 14:
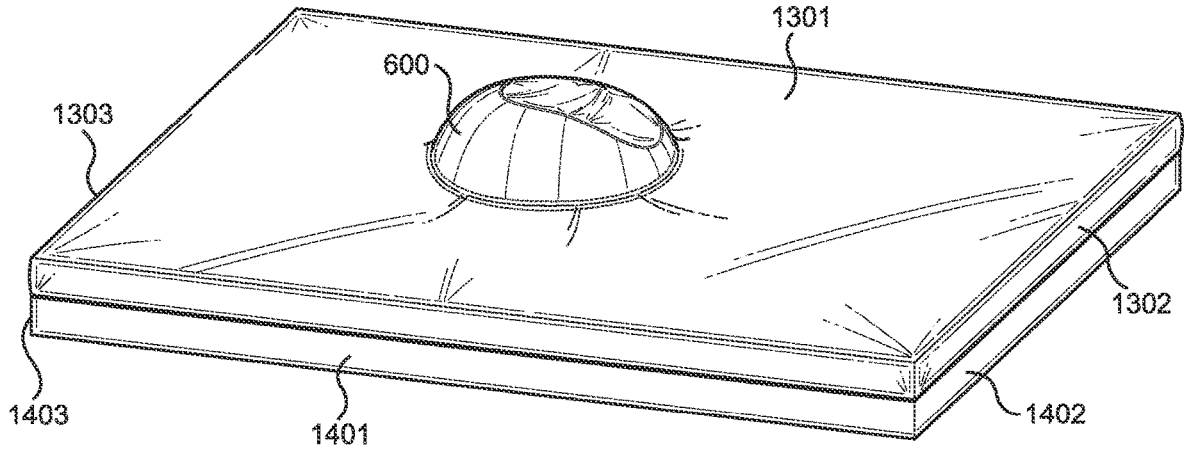
FIG. 14 is an environmental perspective view of the infant support pillow illustrated in FIG. 12.

FIG. 14 demonstrates how the covered pillow 600 with fitted sheet 1301 may fit onto a mattress 1401. The fitted sheet bottom 1302 may align with the mattress bottom 1402 and the fitted sheet top 1303 may align with the mattress top 1403. Likewise, the fitted sheet sides 1304 align with the sides of the mattress 1401. In some embodiments, the covered pillow 600 itself may be positioned proximate the fitted sheet top 1303 and centered between the fitted sheet sides 1304. In other embodiments, the covered pillow 600 may be positioned in the middle of the fitted sheet 1301 equidistant from all sides. However, one skilled in the art will appreciate that the covered pillow 600 may be positioned in any number of orientations and spacing with respect to the fitted sheet 1301.

That which is claimed is:

1. A molded pillow comprising:

a pillow base comprising a first rounded depression and a second rounded depression with a circular edge;

a ridge separating the first rounded depression and second rounded depression;

wherein the first rounded depression has a top to bottom depth greater than the second rounded depression;

wherein the second rounded depression has a smaller diameter than the first rounded depression.

2. The molded pillow of claim 1 wherein the first rounded depression and second rounded depression form a first depression crater and a second depression crater in the pillow base.

3. The molded pillow of claim 2 wherein the first depression crater is sized to match the average dimensions of the back of an infant's head.

4. The molded pillow of claim 2 wherein the second depression crater is sized to match the average dimensions of the back of an infant's neck.

5. The molded pillow of claim 1 wherein the pillow base is a half sphere with a flat bottom and a rounded top.

6. The molded pillow of claim 5 wherein the rounded top houses the first depression and the second depression.

7. The molded pillow of claim 1 wherein the pillow base is made from a rigid polyester bi-component low melt fiber material.

8. The molded pillow of claim 1 wherein the first rounded depression is centrally located within the pillow base and the second rounded depression is located proximate a pillow base front.

9. A molded pillow comprising:

a pillow base comprising a first rounded depression and a second rounded depression with a circular edge;

a ridge separating the first rounded depression and second rounded depression;

a flexible covering enveloping the pillow base;

wherein the first rounded depression has a top to bottom depth greater than the second rounded depression;

wherein the second rounded depression has a smaller diameter than the first rounded depression; and wherein the flexible covering is configured to resistively sink into the first rounded depression and the second rounded depression when external force is applied.

10. The molded pillow of claim 9 wherein the flexible covering is configured to suspend the back of an infant's head within the first rounded depression.

11. The molded pillow of claim 9 wherein the flexible covering comprises a tension overtop the first rounded depression and second rounded depression configured to conform the fabric geometrically to a majority of the first rounded depression and second rounded depression when external force is applied.

12. The molded pillow of claim 9 wherein the first rounded depression and the second rounded depression are concave indentions in the pillow base.

13. The molded pillow of claim 9 wherein the flexible covering is made of at least one of spandex, polyester, and cotton.

14. The molded pillow of claim 9 wherein the pillow base comprises a first exterior depth measured from a back edge of the first rounded depression that is greater than a second exterior depth measured from a front edge of the second rounded depression.

15. The molded pillow of claim 9 wherein the first rounded depression is molded to match the average dimensions of the back of an infant's head.

16. The molded pillow of claim 9 wherein the second rounded depression is molded to match the average dimensions of the back of an infant's neck.

17. A molded pillow comprising:

a pillow base comprising a first rounded depression and a second rounded depression with a circular edge;

a ridge separating the first rounded depression and second rounded depression;

a flexible covering enveloping the pillow base;

a fitted sheet fixedly attached to at least one of the flexible covering and the pillow base;

wherein the first rounded depression is molded to match the average dimensions of the back of an infant's head;

wherein the second rounded depression is molded to match the average dimensions of the back of an infant's neck;

wherein the first rounded depression has a top to bottom depth greater than the second rounded depression;

wherein the second rounded depression has a smaller diameter than the first rounded depression; and wherein the flexible covering is configured to resistively sink into the first rounded depression and the second rounded depression when external force is applied.

18. The molded pillow of claim 17 wherein the pillow base is a half sphere with a flat bottom and a rounded top.

19. The molded pillow of claim 18 wherein the rounded top houses the first depression and the second depression.

* * * * *